US008695169B2

(12) United States Patent
Schäffler et al.

(10) Patent No.: US 8,695,169 B2
(45) Date of Patent: Apr. 15, 2014

(54) DRAWING FRAME HAVING A GUIDE TABLE FOR A GUIDE APRON

(75) Inventors: Gernot Schäffler, Wäschenbeuren (DE); Manfred Bauer, Geislingen/Steige (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 13/635,050

(22) PCT Filed: Mar. 10, 2011

(86) PCT No.: PCT/EP2011/053624

§ 371 (c)(1), (2), (4) Date: Sep. 14, 2012

(87) PCT Pub. No.: WO2011/113744

PCT Pub. Date: Sep. 22, 2011

(65) Prior Publication Data

US 2013/0000081 A1 Jan. 3, 2013

(30) Foreign Application Priority Data

Mar. 16, 2010 (DE) ..... 10 2010 011 489

(51) Int. Cl.
*D01H 5/86* (2006.01)

(52) U.S. Cl.
USPC ..... 19/253

(58) Field of Classification Search
USPC ..... 19/244, 252, 253, 256, 294
See application file for complete search history.

(56) References Cited

U.S. PATENT DOCUMENTS 2,597,278 A * 5/1952 Haythornthwaite et al. ... 19/260

(Continued)

FOREIGN PATENT DOCUMENTS

DE 1 835 763 7/1961
DE 2 310 105 9/1974

(Continued)

OTHER PUBLICATIONS

International Preliminary Report on Patentability and Written Opinion, Sep. 27, 2012.

(Continued)

*Primary Examiner* — Shaun R Hurley
(74) *Attorney, Agent, or Firm* — Dority & Manning, P.A.

(57) ABSTRACT

A drawing frame (1) is described for drawing a fiber slubbing (14) of a workstation of a textile machine having two roller pairs (2, 3) which are arranged behind one another in the transport direction (A) and in each case contain a drafting roller (4, 6) which can be driven, wherein the first drafting roller (4) in the transport direction (A) is assigned a guide apron (8) which wraps around this drafting roller (4) and a guide table (10) which is arranged between the first (4) and the second (6) drafting roller. It is provided according to the invention that the first drafting roller (4) is mounted in a bearing slide (19) which can be displaced in the transport direction (A), and the second drafting roller (6) is mounted in a bearing block (22), and that the guide table (10) is fixed on the bearing block (22) of the second drafting roller (6).

6 Claims, 3 Drawing Sheets

(56) References Cited

U.S. PATENT DOCUMENTS

| | | | | | |
|---|---|---|---|---|---|
| 2,942,307 | A | | 6/1960 | Schiltknecht et al. | |
| 3,031,724 | A | * | 5/1962 | Butler | 19/250 |
| 3,055,060 | A | | 9/1962 | Schiltknecht | |
| 4,727,626 | A | * | 3/1988 | Vinas | 19/244 |
| 5,042,112 | A | * | 8/1991 | Stahlecker | 19/252 |
| 5,335,397 | A | * | 8/1994 | Stahlecker | 19/255 |
| 5,359,943 | A | | 11/1994 | Stahlecker et al. | |
| 5,465,465 | A | * | 11/1995 | Stahlecker | 19/292 |
| 5,918,456 | A | * | 7/1999 | Darcis | 57/315 |

FOREIGN PATENT DOCUMENTS

| | | | |
|---|---|---|---|
| DE | 195 47 462 | A1 | 6/1997 |
| DE | 10 2005 045 876 | A1 | 8/2006 |
| EP | 2 034 060 | | 3/2009 |

OTHER PUBLICATIONS

PCT Search Report, Jul. 11, 2011.

* cited by examiner

DRAWING FRAME HAVING A GUIDE TABLE FOR A GUIDE APRON

FIELD OF THE INVENTION

The present invention relates to a drafting unit for drafting a fibre strand of a working station of a textile machine comprising, in transport direction, two roller pairs arranged one downstream of the other, each of which comprises a driveable bottom roller. A guiding apron is assigned to the first bottom roller in the transport direction, the guiding apron looping this bottom roller as well as a guiding table. The guiding table is arranged between the first and second bottom roller.

BACKGROUND

A drafting unit of this type is known from German published patent application DE 10 2005 045 876 A1. In the known drafting unit, a guiding table denoted as a "deflecting element" is applied to a stationary frame part of the drafting unit. The bottom rollers are supported in the frame of the drafting unit. The guiding table is alterable in its position in relation to the bottom rollers, so that the tension of the bottom apron can be adjusted.

SUMMARY

It is an object of the present invention to improve the drafting unit and the evenness of the drafted fibre strand. Additional objects and advantages of the invention will be set forth in part in the following description, or may be obvious from the description, or may be learned through practice of the invention.

Objects of the invention have been achieved in the case of the drafting unit of the above-mentioned type in that the first bottom roller is supported in a bearing carriage movable in the transport direction, and the second bottom roller is supported in a bearing block, and the guiding table is affixed to the bearing block of the second bottom roller.

The drafting unit of the present invention has the advantage that the position of the guiding table in relation to the second bottom roller is fixed and cannot be altered. In the production of the bearing block for the second bottom roller, the position of the guiding table can be specified at very low tolerance levels. As a result, the bottom apron can be guided very closely past the bottom roller.

In the case of drafting units operating at high speeds, in particular in which the bottom roller, arranged downstream of the guiding apron, rotates at a high speed, drag flow occurs at the bottom roller. Due to its rotation, the rapidly rotating surface of the bottom roller takes air along and transports it to the area of the drafting zone in which the fibre strand exits from the apron aggregate. This effect is increased in that the bottom roller usually comprises a surface having grooves.

In order that the bottom apron does not brush against the significantly faster bottom roller and is damaged, only a minimal gap between the surface of the guiding apron and the bottom roller surface is necessary, said gap measuring advantageously just a few tenths of a millimeter. This very narrow distance keeps the drag flow generated by the bottom roller away from the fibre strand to the greatest possible extent.

A worn guiding apron must be replaced. The new guiding apron is tensioned in that the bearing carriage of the first bottom roller is slid with a defined force in the opposite direction to the transport direction. The dislocation of the bearing carriage can balance out the tolerances of the circumferential length of the guiding apron conditional of manufacturing. The guiding table remains in its unaltered position so that the gap between the new guiding apron and the bottom roller remains exactly as small as before. This is a significant advantage.

It has surprisingly been shown that even small changes in this area cause changes in the air current in the area between the guiding apron and the second roller pair where the fibre strand is not guided, and can impair the drafting process there, in particular the evenness of the drafted fibre strand.

A frame is provided which supports the drafting unit. The frame can be a single frame for a single drafting unit or a joint frame for a number of adjacent drafting units. The bearing block and the bearing carriage are each one component having a take-up for a bearing for supporting the respective bottom roller. The bearing carriage can be shifted along a linear guide, for example a rail. The linear guide can be advantageously fixed in a stationary manner to the frame. The bearing carriage can, for example, be fixed by means of one or a number of screws to the frame. By arranging a slot hole or a groove to the screw, the bearing carriage can be positioned variably as required. The bearing block is advantageously fixed in a stationary manner to the frame or is integrated into the frame, in particular when the bottom roller supported in the bearing block is the front bottom roller. Alternatively, it can also be provided that the position of the bearing block, together with the guiding table, is adjustable in relation to the frame or to an air jet aggregate arranged downstream of the front roller pair. An adjustable position of the bearing block is also advantageous when a further bottom roller is arranged downstream of the bottom roller supported in the bearing block.

The drafting unit of the present invention can be a single drafting unit driven separately for a single working station of a textile machine. It is advantageous when the first bottom roller in the bearing carriage and the second bottom roller in the bearing block are each in an overhung position. The drafting unit is particularly suitable for a rapidly operating spinning machine, for example an air jet spinning machine, or a knitting machine for producing a knitted fabric from a non-twisted fibre material using a process in which the fibre strand delivered by the drafting unit is fed directly to a knitting arrangement.

In an embodiment of the invention, it is advantageous when the guiding table comprises a replaceable element that can be exchanged for the purposes of adaptation to the guiding geometry of the guiding apron in the drafting zone. The guiding table advantageously comprises a take-up for the exchangeable element. The take-up is advantageously U-shaped, T-shaped or swallow-tailed in shape in order to ensure a good positioning of the exchangeable element. The exchangeable element can comprise various geometric shapes that effect changes in the way the apron runs in the drafting zone. By means thereof, the drafting unit can be adapted to the type of fibre strand to be drafted. Various exchangeable elements are advantageously so designed that the distance between the guiding apron and the surface of the second bottom roller does not alter, so that the air current conditions also do not change when the exchangeable element is replaced by another element.

In a further advantageous embodiment of the present invention it, can be advantageous that a tensioning device for tensioning the guiding belt is arranged between the bearing carriage and the bearing block. The tensioning device can advantageously take the form of a pressure spring arranged between the bearing carriage and the bearing block. When the guiding apron is replaced by a new apron, the desired tension of the guiding apron can be very easily adjusted. The fixing elements of the bearing carriage need only be slightly loosened and the bearing carriage is slid only so far that the guiding apron acquires the desired tension level.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION

Figure 1:
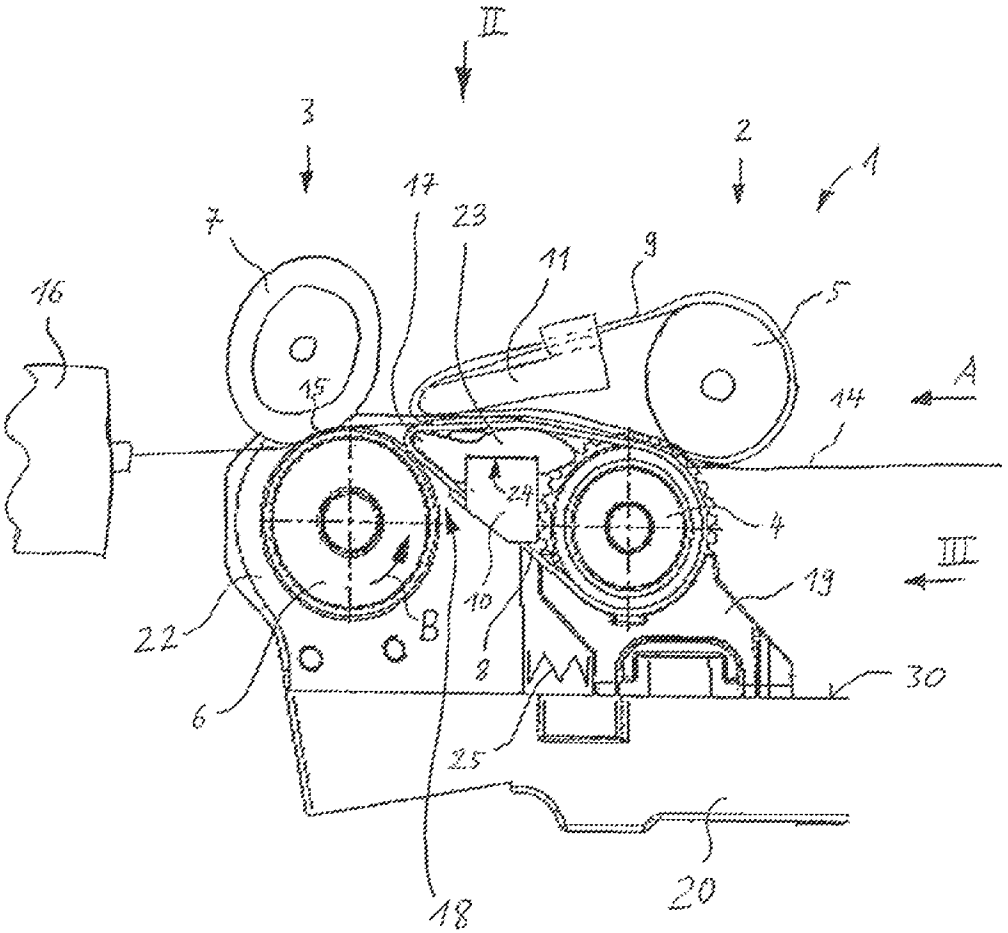
FIG. 1 shows a schematic side view of a partly shown double apron drafting unit according to the present invention.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

Figure 2:
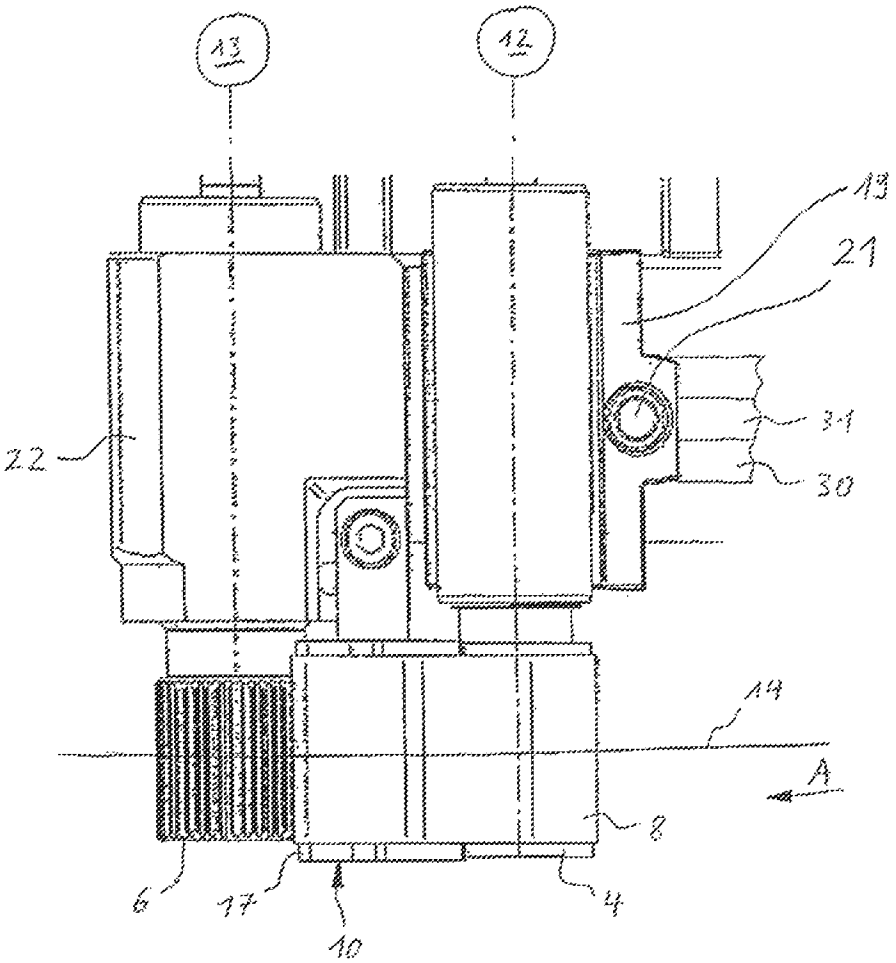
FIG. 2 is a top view in the direction of the arrow II of FIG. 1 of the drafting unit, wherein the top rollers and the top apron have been omitted for the sake of clarity.
Figure 3:
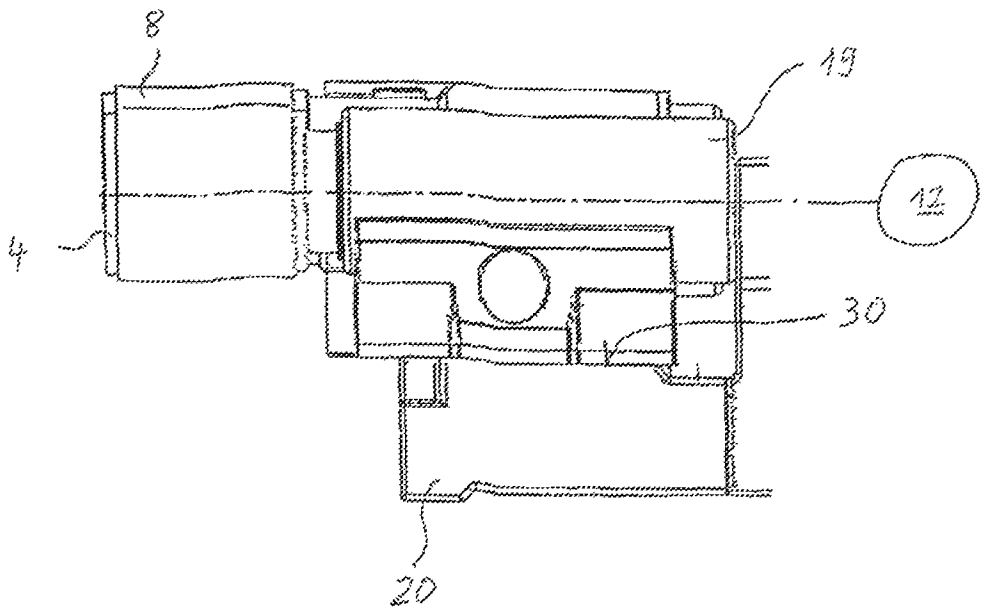
FIG. 3 is a view in the direction of the arrow III of FIG. 1, wherein the top rollers are again omitted.

In the FIGS. 1 to 3, a double apron drafting unit 1 is shown. The drafting unit 1 comprises two roller pairs 2 and 3, each of which comprises a bottom and a top roller. The drafting unit 1 can comprise further roller pairs (not shown here) arranged upstream of the roller pair 2 and/or arranged downstream of roller pair 3. The roller pair 2 consists of a bottom roller 4 and a top roller 5. The roller pair 3 consists of a bottom roller 6 and a top roller 7, which, in the known way, comprises a covering made of flexible rubber. The top rollers 5, 7 are pressed by means of a loading device (not shown) onto the bottom rollers 4, 6. The rollers 4, 5 are each looped by a guiding apron 8, 9. The bottom apron 8 also loops a guiding table 10. A top roller cradle 11 guides the top apron 9. The bottom rollers 4, 6 are each connected to a drive 12, 13 and driveable by means thereof, as is schematically shown in FIG. 2.

A fibre strand 14 of staple fibres to be drafted is fed to the first roller pair 2 in transport direction A. The second roller pair 3 rotates at a significantly higher circumferential speed than the roller pair 2. The fibre strand is hereby drafted to a low degree of fineness. In the present case the fibre strand 14 completes the drafting process at the nipping line 15 of the second roller pair 3 and is fed to an air jet aggregate 16 which imparts the fibre strand 14 its twist. The produced yarn is spooled downstream of the air jet aggregate in a way not shown. The drives 12, 13 are controlled separately so that the draft and the delivery speed of the fibre strand 14 are variable independently of other working stations.

The bottom roller 6 generates, by means of its rotation in the direction of the arrow B, a drag flow which propels air into the wedge-shaped gap upstream of the nipping line 15. In this area, when the fibre strand leaves the guiding apron 8, 9 and is not yet nipped in the nipping line 15, the fibre strand 14 to be drafted is, at this point, not guided and is therefore susceptible to damage. Therefore the guiding table 10 is arranged in such a way that the guiding apron 8, by means of its deflecting edge 17, is guided past as closely as possible to the surface of the bottom roller 6. The gap 18 between the guiding apron 8 and the bottom roller 6 measures less than 0.5 mm. By means thereof, the drag flow is kept away from the fibre strand 14 to the greatest possible extent.

The bottom rollers 4 and 6 are both supported in an overhung position. The bottom roller 4 is supported in a bearing carriage 19. The bearing carriage 19 sits on a roller stand or a frame 20 of the drafting unit 1 and is movable in transport direction A along a linear guide 30. A rail on which the bearing carriage 20 rests forms the linear guide 30. A screw 21 is provided to fix the bearing carriage 19. In the linear guide 30, a slot hole or a groove 31 is arranged to a screw 21. When the bearing carriage 19 has been shifted to the required position, the bearing carriage 19 is affixed by means of the screw 21. The bottom roller 6 is supported in a bearing block 22, which is also fixed to the frame 20. In the present case shown, the second roller pair 3 are the front roller pair of the drafting unit 1, so that an ability to move the bearing block 22 in transport direction A, or adjustability in relation to the frame 20, are not absolutely necessary.

It is provided in accordance with the present invention that the guiding table 10 is fixed to the bearing block 22. This ensures that the gap 18 is as small as possible without however the bottom apron 8 and the bottom roller 6 coming into contact with one another. Due to the very high relative speed between the bottom roller 6 and the guiding apron 8, the guiding apron 8 would be destroyed very quickly if it came into contact with the bottom roller 6. The guiding table 10 comprises a replaceable element 23 which defines the guiding geometry of the guiding apron 8 in the drafting zone and which also comprises the deflecting edge 17. Depending on the material of the fibre strand 14 to be drafted, it can be advantageous to guide the guiding aprons 8, 9, and thus the fibre strand 14, along another path through the drafting zone between the roller pairs 2 and 3. The guiding table comprises a U-shaped take-up 24 for the replaceable element 23. It is ensured that the element 23 can be very easily replaced with another element having a different guiding geometry, and that the new element 23 can be positioned reliably and securely in its pre-determined position on the U-shaped take-up 24. When the element 23 is replaced it is ensured that the guiding edge 17, the position of which defines the size of the gap 18, always maintains the same distance from the surface of the bottom roller 6. By means thereof, the guiding geometry in the drafting zone can be changed without risk of the fibre strand 14 being impaired upstream of the nipping line 15 by unspecified air currents.

In order to devise a very simple way of regularly replacing the guiding apron when necessary, a tensioning device 25 for tensioning the guiding apron 8 is arranged between the bearing carriage 19 and the bearing block 22. The tension device 25 advantageously consists of a pressure spring that is supported on the bearing block 22. The pressure spring, subsequent to loosening the screw 21 slightly, presses the bearing carriage 19 in the opposite direction to the transport direction A so that the guiding apron 8 is tensioned with a defined force. In order that the bearing carriage 19 does not execute any periodic fluctuating movements during operation, the bearing carriage 19 is fixed in such a way that it is stationary during operation by means of a screw 21 in the frame 20. If the drafting unit 1 is installed in the textile machine in such a way that the transport direction A travels vertically upwards, it is, alternatively, also possible to omit the tensioning device and to adjust the desired tension of the guiding apron 8 in such a way that the component group consisting of bearing carriage 19 and bottom roller 4 weigh accordingly so that the desired tension of the guiding apron 8 is generated by the corresponding operating weight of the components when the screw 21 is loosened slightly.

This invention is not restricted to the embodiments shown. Variations within the claims are certainly possible.

The invention claimed is:

1. A drafting unit for drafting a fiber strand of a working station of a textile machine, comprising:

a first roller pair, and a second roller pair arranged downstream of said first roller pair in a transport direction of the fiber strand;

each of said first roller pair and said second roller pair having a drivable bottom roller;

a guiding apron looping said drivable bottom roller of said first roller pair;

a guiding table configured between said drivable bottom rollers of said first roller pair and said second roller pair, said guiding apron looping said guiding table;

said bottom roller of said first roller pair supported in a bearing carriage that is movable along the transport direction;

said bottom roller of said second roller pair supported in a bearing block;

said guiding table fixed to said bearing block; and wherein tension of said guiding apron is adjusted by movement of said bearing carriage along the transport direction while said guiding table remains stationarily fixed to said bearing block.

2. The drafting unit as in claim 1, wherein said bottom roller of said first roller pair is supported in said bearing carriage in an overhung position.

3. The drafting unit as in claim 1, wherein said bottom roller of said second roller pair is supported in said bearing block in an overhung position.

4. The drafting unit as in claim 1, wherein said guiding table is configured with a replaceable element defining a guiding geometry for said guiding apron in a drafting zone between said first and second roller pairs, said element replaceable for changing the guiding geometry of said guiding apron in said drafting zone.

5. The drafting unit as in claim 1, wherein said bearing block is adjustably mounted to a frame and is adjustable relative to an air jet aggregate downstream of said second roller pair in the transport direction.

6. A drafting unit for drafting a fiber strand of a working station of a textile machine, comprising:

a first roller pair, and a second roller pair arranged downstream of said first roller pair in a transport direction of the fiber strand;

each of said first roller pair and said second roller pair having a drivable bottom roller;

a guiding apron looping said drivable bottom roller of said first roller pair;

a guiding table configured between said drivable bottom rollers of said first roller pair and said second roller pair, said guiding apron looping said guiding table;

said bottom roller of said first roller pair supported in a bearing carriage that is movable along the transport direction;

said bottom roller of said second roller pair supported in a bearing block;

said guiding table fixed to said bearing block; and further comprising a tensioning device configured between said bearing carriage and said bearing block for tensioning said guiding apron.

* * * * *